United States Patent [19]

Cangiano et al.

[11] 3,989,549

[45] Nov. 2, 1976

[54] METHOD OF MAKING INCANDESCENT LAMP

[75] Inventors: Frank Cangiano; Stephen A. Reed, III, both of Hillsboro; Wilfred L. Boule, Antrim; David R. Dayton, Bow, all of N.H.

[73] Assignee: GTE Sylvania Incorporated, Danvers, Mass.

[22] Filed: Apr. 21, 1975

[21] Appl. No.: 570,284

[52] U.S. Cl. ..... 148/6.3; 148/11.5 F; 148/20.3; 148/133; 140/71.5; 427/111

[51] Int. Cl.[2] ..... H01K 1/08

[58] Field of Search ..... 140/71.5; 148/11.5 F, 148/13.1, 20.3, 133, 6.3

[56] References Cited

UNITED STATES PATENTS

| | | | |
|---|---|---|---|
| 1,017,280 | 2/1912 | von Bolton | 148/133 X |
| 1,086,171 | 2/1914 | Henderson | 148/20.3 X |
| 1,605,192 | 11/1926 | McAllister | 148/20.3 |
| 3,662,789 | 5/1972 | Koo et al. | 140/71.5 |

*Primary Examiner*—Ralph S. Kendall
*Attorney, Agent, or Firm*—James Theodosopoulos

[57] ABSTRACT

The coiled tungsten filament of an incandescent lamp is made more resistant to sagging by exposing the filament to a vaporized phosphorus atmosphere so as to form tungsten monophosphide on the filament. The filament is subsequently heated in order to dissociate the tungsten monophosphide and evaporate the phosphorus therefrom.

1 Claim, No Drawings

METHOD OF MAKING INCANDESCENT LAMP

THE INVENTION

Filaments for electric incandescent lamps are generally made of wire comprised principally of tungsten with up to several percent of other materials such as thoria, rehenium or dopants for nonsag purposes. The dopants, examples of which are potassium, silicon and aluminum, are included in order to produce a long interlocking crystalline structure in a filament after the filament has been flashed, that is, recrystallized.

An ingot is pressed from a measured quantity of blended tungsten powder and then resistively heated at a high temperature to increase its strength and density. The ingot is then mechanically worked into an elongated rod by swaging operations alternated with strain-relieving annealing steps, as is conventional in the art. Wire is produced from the swaged rod by drawing as, for example, is shown in U.S. Pat. No. 3,262,293 to MacInnus entitled "Method of Manufacturing Wire." After the wire has been drawn to a desired diameter, it is wound on spools.

The wire thus produced has a fibrous structure, which is a result of the swaging and drawing operations, alternated with annealing steps. A fibrous structure is desirable since it results in ductility and workability of the wire and permits it to be coiled, and coil-coiled into various filamentary shapes.

After the filament has been coiled and formed into its final desired shape, the fibrous wire structure is converted into a crystalline structure by flashing, that is, heating to a high temperature, generally above 2,000° C. Ideally, the preferred crystal structure for optimum resistance to sag consists of a long single crystal or, at least, relatively long interlocking crystals, the grain boundaries of which run lengthwise with the wire. The dopants, previously mentioned, aid in the grain growth which yields the desired crystalline structure.

However, the filaments so produced do not always have adequate resistance to sagging during lamp operation, especially in the case of miniature lamps, which have filaments made of very small diameter wire.

It is an object of this invention to provide a manufacturing process for tungsten filaments which improves the nonsag properties thereof.

In a usual filament manufacturing process, tungsten wire is coiled on a mandrel, heated to set the coiling, cut into specific filament lengths and acid treated to dissolve the mandrel. The resultant filament is mounted in an incandescent lamp envelope which is then sealed, and the filament is flashed by passing electric current through it.

In this invention, the filaments are heated in an atmosphere containing phosphorus, before the mandrels are dissolved out of the filaments. The effect of the phosphorus treatment is to make the filaments more resistant to sagging and distortion throughout lamp life than untreated filaments.

In a specific example, several hundred 60 T2 PSB lamps were made in accordance with this invention and compared with 60 T2 PSB lamps made in accordance with the prior art. The lamp has a rating of 60 volts, 50 milliamps, 7500 hours life and is used primarily as a pilot lamp.

The lamp filament consists of 323 mm of 0.56 mil tungsten wire coiled at 1500 TPI on a 3.7 mil molybdenum mandrel. The filaments made in accordance with this invention were processed as follows. Several hundred filaments, still on mandrel, were inserted into a small quartz evacuable bottle, having a volume of about 15 cc, which had previously been evacuated and flamed to degas the quartz.

About 100 milligrams of red phosphorus were added to the bottle which was then evacuated and lightly flamed to degas the filaments and the phosphorus. Flaming was discontinued when a small amount of the phosphorus evaporated and condensed in the exhaust tube of the bottle; the wall temperature of the bottle was about 350° C at this point.

The bottle was then cooled to room temperature and sealed at a vacuum of about 20 microns by tipping off the exhaust tube, after which it was heated in an oven at 800° C for several hours in order to vaporize substantially all the phosphorus and to expose the filaments to the phosphorus atmosphere. Upon removal of the bottle from the oven, the exhaust tube thereof was rapidly cooled, such as by contact thereof with cold water, in order to condense the phosphorus atmosphere in the exhaust tube and not on the surface of the filaments.

After the bottle had cooled to room temperature, it was immersed in water and the exhaust tube was broken off under water. This was a precautionary step, to prevent the possibility of any white phosphorus, which might have formed, from igniting upon exposure to air.

The filaments were moved from the bottle and rinsed in alcohol to dry; then were then rinsed in carbon disulphide to dissolve any condensed phosphorus on the surface of the filaments, rinsed again in alcohol and dried.

Next the filaments were cleaned by heating to a temperature of at least about 1300° C, in a reducing atmosphere or vacuum, in order to remove any phosphorus that had combined with the tungsten to form a phosphide. If such chemically combined phosphorus were not removed, small lamps incorporating the filaments would slowly become yellow during normal operation by the deposition of phosphorus on the glass envelope. In larger lamps, or lamps having a gas fill, such yellowing would not be a problem.

The molybdenum mandrels were then removed from the filaments in the usual manner by dissolving them in nitric and sulfuric acid and the filaments were mounted in lamps and flashed as usual.

Extensive life tests made on hundreds of lamps showed that phosphorus treated filaments sagged less than filaments made in the usual way, i.e., without phosphorus treatment. This was so regardless of whether the additives used in making the tungsten wire were thoria, rhenium or nonsag dopants.

The method by which the phosphorus treatment improves sag-resistance of the tungsten filaments is not completely understood. Analysis of the treated filaments showed that some of the tungsten had combined with the phosphorus to form tungsten monophosphide. However, during the subsequent cleaning or flashing operation, the tungsten monophosphide surface apparently decomposes into gaseous phosphorus and tungsten. This slightly different than normal surface may affect some property of the wire, such as creep, which may aid in preventing the filaments from sagging. X-ray diffraction analysis of the cleaned filaments showed only tungsten; no phosphorus was found.

We claim:

1. In a process of manufacturing an incandescent lamp containing a coiled tungsten filament within a glass envelope, the steps which comprise: coiling tungsten wire on a mandrel to form a coiled filament; heating said coiled filament to about 800° C in a phosphorus atmosphere to form tungsten monophosphide on the surface of the filament; then heating said coiled filament to a temperature of at least about 1300° C in a reducing atmosphere or vacuum to dissociate the tungsten monophosphide and evaporate the phosphorus therefrom; then dissolving said mandrel from said filament; and mounting said filament in said incandescent lamp.

* * * * *